US011358248B1

(12) United States Patent
Schollaart

(10) Patent No.: US 11,358,248 B1
(45) Date of Patent: Jun. 14, 2022

(54) MULTI-TOOL BLADE SHARPENING APPARATUS

(71) Applicant: Visbeen Architects, Inc., East Grand Rapids, MI (US)

(72) Inventor: Daniel J. Schollaart, Hudsonville, MI (US)

(73) Assignee: Visbeen Architects, Inc., East Grand Rapids, MI (US)

( * ) Notice: Subject to any disclaimer, the term of this patent is extended or adjusted under 35 U.S.C. 154(b) by 940 days.

(21) Appl. No.: 15/998,886

(22) Filed: Aug. 16, 2018

Related U.S. Application Data

(60) Provisional application No. 62/546,734, filed on Aug. 17, 2017.

(51) Int. Cl.
*B24B 3/58* (2006.01)
*B24B 41/06* (2012.01)

(52) U.S. Cl.
CPC ..... *B24B 3/586* (2013.01); *B24B 41/06* (2013.01)

(58) Field of Classification Search
CPC .... B24D 15/085; B24D 15/087; B24B 3/546; B24B 3/586
See application file for complete search history.

(56) References Cited

U.S. PATENT DOCUMENTS 1,444,598 A * 2/1923 Ferguson ..... B24B 3/52 451/186
1,909,033 A * 5/1933 Yerkey ..... B24B 3/52 451/186
1,961,504 A * 6/1934 McMillan ..... B24B 3/58 451/239
2,041,340 A * 5/1936 Hartman ..... B24B 3/58 451/239
2,097,068 A * 10/1937 Johnson ..... B24B 3/58 451/232
2,118,197 A * 5/1938 Hartman ..... B24B 3/58 451/121
2,716,845 A * 9/1955 Viall, Jr. ..... B24B 3/42 451/141
2,769,281 A * 11/1956 Jones ..... B24B 3/52 451/226

FOREIGN PATENT DOCUMENTS

CN 101829813 11/2012

* cited by examiner

*Primary Examiner* — Joel D Crandall
(74) *Attorney, Agent, or Firm* — Gardner, Linn, Burkhart & Ondersma LLP

(57) ABSTRACT

A blade sharpening apparatus for sharpening a serrated blade includes a blade holder configured to securely hold a serrated blade in a position that exposes a toothed edge of the serrated blade. A grinding wheel rotates about a rotational axis and engages teeth spaced along the toothed edge of the serrated blade that is secured in the blade holder. An oscillating mechanism laterally oscillates the blade holder or the grinding wheel relative to the other at an oscillating distance greater than a depth between the teeth on the serrated blade. A linear actuator longitudinally moves the blade holder or the grinding wheel relative to the other and substantially parallel with the rotational axis of the grinding wheel. The linear actuator is operable with the oscillating mechanism to coincide the longitudinal and lateral movement to correspond to the depth and spacing of the teeth disposed along the serrated blade.

17 Claims, 6 Drawing Sheets

MULTI-TOOL BLADE SHARPENING APPARATUS

CROSS REFERENCE TO RELATED APPLICATION

The application claims the filing benefits of U.S. provisional application Ser. No. 62/546,734, filed Aug. 17, 2017, which is hereby incorporated herein by reference in its entirety.

FIELD OF THE INVENTION

The present invention relates generally to a blade sharpener and, more particularly, to a sharpening device for serrated blades or blades having teeth or serrations, such as knives, saw blades and the like.

BACKGROUND OF THE INVENTION

It is well known to sharpen smooth blades, such as knife blades and lawn mower blades, by manually moving the blade over a grinding wheel at a desired angle or angles to provide a sharpened edge along the blade that prolongs the useful life of the blade. For serrated blades, manually sharpening can be much more difficult to accomplish in a manner that preserves the shape of the teeth or serrations on the blade and that provides a consistent sharpened edge along the length of the blade. Accordingly, it is common for some serrated blades to be removed from an associated tool when the blade is dull and discarded to be replaced with a new serrated blade.

SUMMARY OF THE INVENTION

The present invention provides a blade sharpening apparatus and method for sharpening a serrated blade in a precise and generally consistent manner. The serrated blade is securely held in a position with a blade holder, such as a clamping device, that exposes a toothed edge of the serrated blade. A grinding wheel is provided that rotates and has a grinding edge that is shaped to engage the teeth or serrations spaced along the toothed edge of the selected serrated blade that is secured in the blade holder. An oscillating mechanism provides lateral oscillation between the blade holder and the grinding wheel at an oscillating distance that is selected to correlate with the depth between the teeth or serrations on the serrated blade. A linear actuator provides longitudinal movement between the blade holder and the grinding wheel that is substantially parallel with the rotational axis of the grinding wheel. The linear actuator is operable with the oscillating mechanism to coincide the longitudinal and lateral movements to correspond to the depth and spacing of the teeth or serrations disposed along the serrated blade, such that the serrated blade is sharpened consistently across the blade, while maintaining the teeth or serrations and overall shape of the serrated edge. Accordingly, with the use of such an apparatus and method, sharpening previously used serrated blades can prolong the useful life of a serrated blade and can be more economical than discarding and replacing dull serrated blades.

In accordance with one aspect of the present invention, a blade sharpening apparatus for sharpening a serrated blade includes a blade holder configured to securely hold a serrated blade in a position that exposes a toothed or serrated edge of the serrated blade. The blade sharpening apparatus also includes a grinding wheel that is configured to rotate about a rotational axis and engage teeth or serrations spaced along the toothed or serrated edge of the serrated blade that is secured in the blade holder. An oscillating mechanism is configured to laterally oscillate the blade holder or the grinding wheel relative to the other at an oscillating distance greater than a depth between the teeth or serrations on the serrated blade. A linear actuator is coupled with one of the blade holder and the grinding wheel and configured to longitudinally move substantially parallel with the rotational axis of the grinding wheel. The linear actuator is operable with the oscillating mechanism to coincide the longitudinal and lateral movement to correspond to the depth and spacing of the teeth or serrations disposed along the serrated blade.

In accordance with another aspect of the present invention, a blade sharpening apparatus for sharpening a serrated blade includes a base structure configured to rest on a support surface and a blade holder coupled with the base structure and configured to securely hold a serrated blade in a position that exposes a toothed or serrated edge of the serrated blade. A threaded rod is rotatably coupled with the base structure about a rotational axis that is offset a fixed distance from a center axis of the threaded rod. A support rod is coupled with the base structure in substantially parallel alignment with the threaded rod and at a spaced distance from the rotational axis of the threaded rod. A grinding wheel is rotationally attached to a shaft and configured to engage teeth or serrations spaced along the toothed or serrated edge of the serrated blade that is secured in the blade holder. The grinding wheel is engaged with the threaded rod and the support rod, and wherein, responsive to rotation of the threaded rod about the rotation axis, the grinding wheel is moved in coinciding oscillating lateral movement and linear longitudinal movement that is configured to move the grinding wheel against the serrated blade to sharpen the toothed or serrated edge of the serrated blade.

In accordance with yet another aspect of the present invention, a method of sharpening a serrated blade includes securing a blade at a blade holder to expose a serrated edge of the blade. A grinding wheel is rotated about a rotational axis. The blade holder or the grinding wheel is laterally oscillated relative to the other at an oscillating distance configured to sharpen a depth between teeth or serrations that are spaced along the serrated edge of the blade. The blade holder or the grinding wheel is moved longitudinally in substantially parallel alignment with the rotational axis of the grinding wheel. The longitudinal and lateral movements coincide to correspond to the depth and spacing of the teeth or serrations along the serrated edge of the blade.

The blade sharpening apparatus and methods of the present invention provide for a coordinated longitudinal and lateral movement between a grinding wheel and a serrated blade such that those longitudinal and lateral movements are configured to coincide in a manner that corresponds to the depth and spacing of the teeth or serrations along the serrated edge of the blade.

These and other objects, advantages, purposes and features of the present invention will become apparent upon review of the following specification in conjunction with the drawings.

DESCRIPTION OF THE PREFERRED EMBODIMENTS

Figure 3:
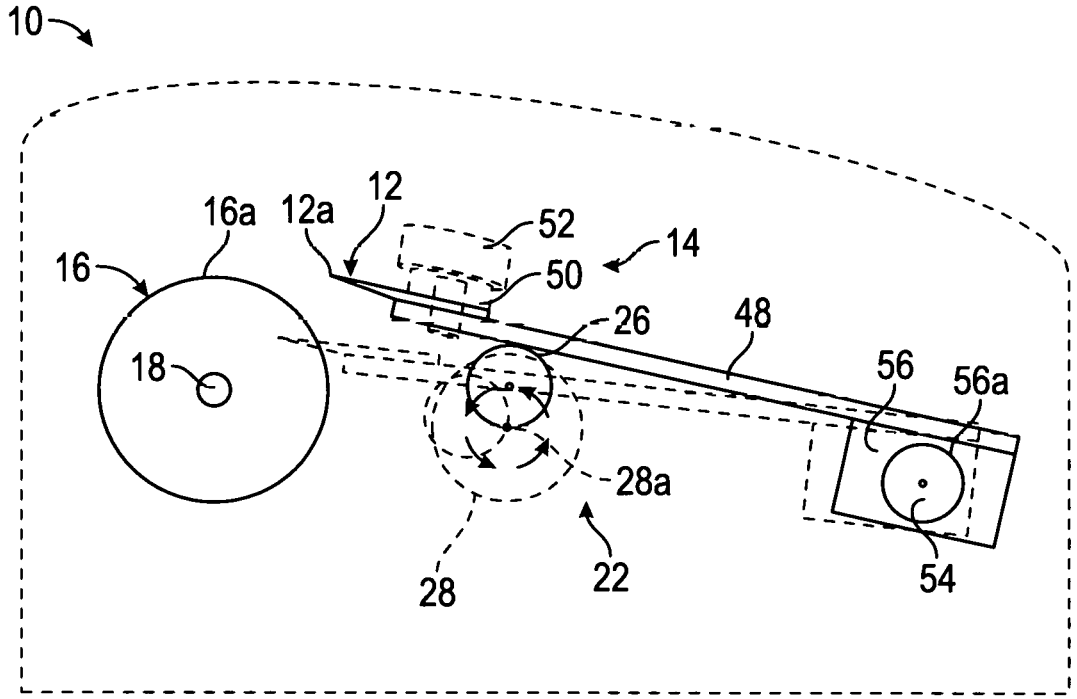
FIG. 3 is a schematic side elevational view of a blade sharpening apparatus, in accordance with the present invention.

Referring now to the drawings and the illustrative embodiments depicted therein, a blade sharpening apparatus 10 for sharpening a serrated blade 12 (FIG. 4) includes a blade holder 14 that securely holds the serrated blade 12, such as with a clamping device, to expose a toothed or serrated edge 12*a* of the blade for sharpening. A grinding wheel 16 is provided that rotates about a generally fixed axis 18 (FIG. 3) by a motor, such as an electric motor 20. The grinding wheel 16 has an edge 16*a* at or near the circumference of the wheel that is shaped to engage a type or size range of teeth or serrations spaced along an edge of a serrated blade secured in the blade holder 14, such as the teeth or serrations along the edge 12*a* of the blade 12 engaging the grinding wheel 16, such as shown in FIG. 3. An oscillating mechanism 22 is used to provide lateral oscillation between the blade holder 14 and the grinding wheel 16 that generally corresponds with the depth between the teeth or serrations on the serrated blade 12. A linear actuator 24 provides longitudinal movement between the blade holder 14 and the grinding wheel 16 that is substantially parallel with the rotational axis 18 of the grinding wheel 16. The linear actuator 24 is operable with the oscillating mechanism 22 to coincide the longitudinal and lateral movements, such as by rotating a threaded rod 26 about an offset rotational coupling 28, to correspond with the shape along the edge 12*a* of the serrated blade 12. Such coinciding longitudinal and lateral movements allow the grinding wheel 16 to move into and out of the spacing between the teeth disposed along the serrated blade 12. Throughout the specification and claims, it will be appreciated that the terms "serration" and "serrated" are used interchangeably with "tooth" and "toothed", unless specifically stated otherwise.

The blade sharpening apparatus 10 includes a base structure 30 to support the operational devices of the blade sharpening apparatus, such as the grinding wheel 16, oscillating mechanism 22, and linear actuator 24, at the desired positions to properly function together. The base structure may thereby include mounting surfaces, apertures, brackets and the like that are designed to package the operational components of the blade sharpening apparatus 10. The base structure may be integrated into one or more additional structures or may rest on a support surface, such as a counter, table, workbench, or the like. The base structure 30 shown in FIG. 1 includes a housing 32 that has a floor 33 and exterior walls 34 surrounding an interior area, which may be divided by one or more interior walls, such as shown with an interior wall 36 separating the interior area into a sharpening area 38 and an electrical component area 40. The walls may be attached together with fasteners, as shown, or may also or alternatively be connected with adhesive, welding, or otherwise integrally formed together. Also, the walls may include ventilation openings, such as for allowing air cooling of the electric motor 20 and circuitry of the power supply 21.

Figure 1:
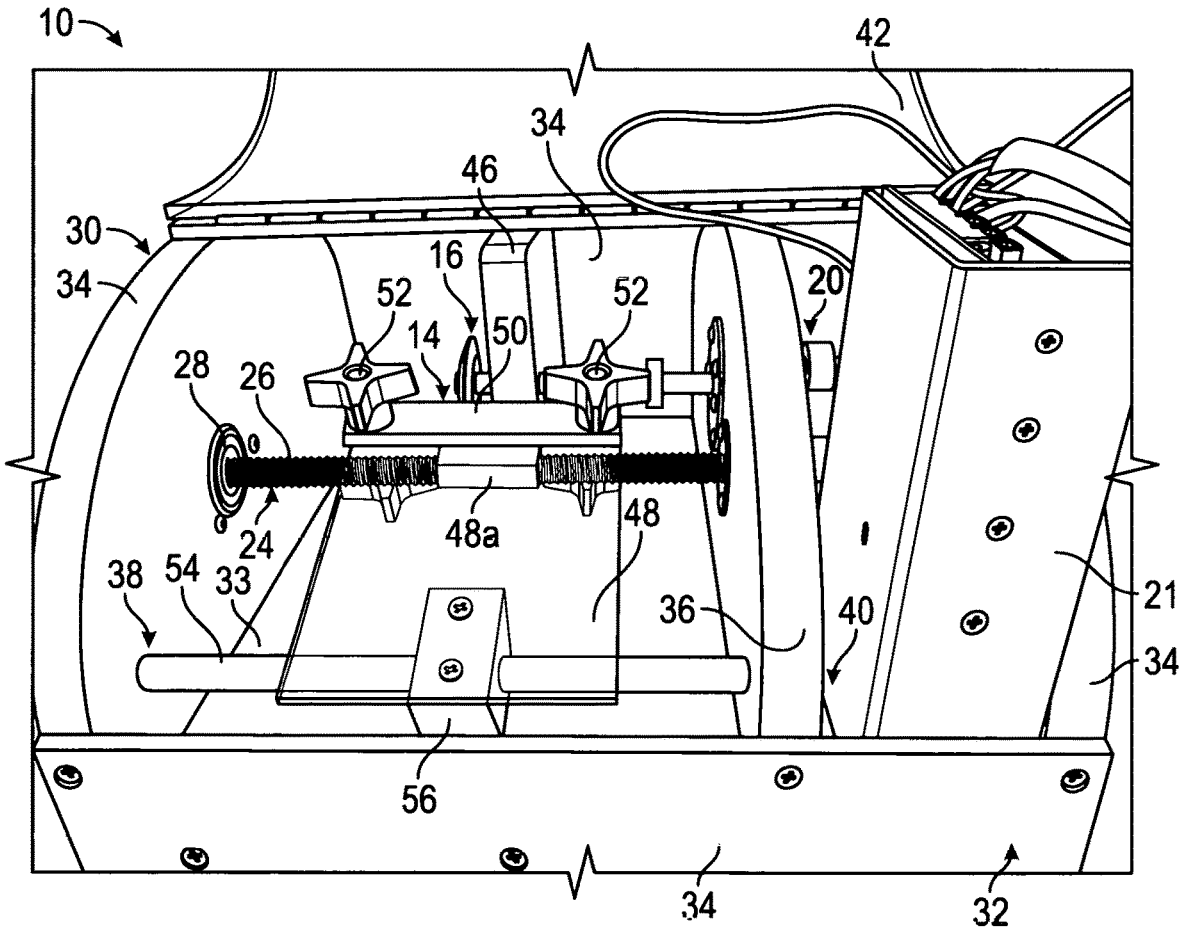
FIG. 1 is an upper perspective view of a blade sharpening apparatus with a protective cover of the housing moved to an open position, in accordance with the present invention.

The housing 32 may also include a lid or cover 42 that attaches at the rear exterior wall, such as via a hinge, so that the cover 42 is capable of pivoting between an open position (FIG. 1) that allows access to the interior area and a closed position that prevents sparks or debris or the like from exiting the sharpening area 38 of the housing 32. The cover 42, as shown in FIG. 1, comprises a transparent material, such as a plastic or glass pane, that allows the internal operation of the blade sharpening apparatus 10 to be visible and thereby capable of being visually monitored by user. To further enhance visibility, the illustrated cover 42 includes a curvature that arches over the upper portion of the exposed interior area occupied by the operational devices of the blade sharpening apparatus 10. The cover 42 also partially extends downward to form a portion of the front exterior wall, such that the substantially parallel side exterior walls and interior wall 36 each have a curved upper edge that corresponds with the curvature of the cover 42. Thus, the cover 42 is shaped to close against or near the upper edges of the exterior and interior walls 34, 36 of the housing 32 to generally enclose at least a portion of the interior area. Also, the cover 42 may interface with or include a sensor, such as a lever, plunger or roller switch or the like, which may operate as a switch for an automatic shut off that slows or stops the rotation of the grinding wheel when the cover opens away from the closed position.

Figure 2:
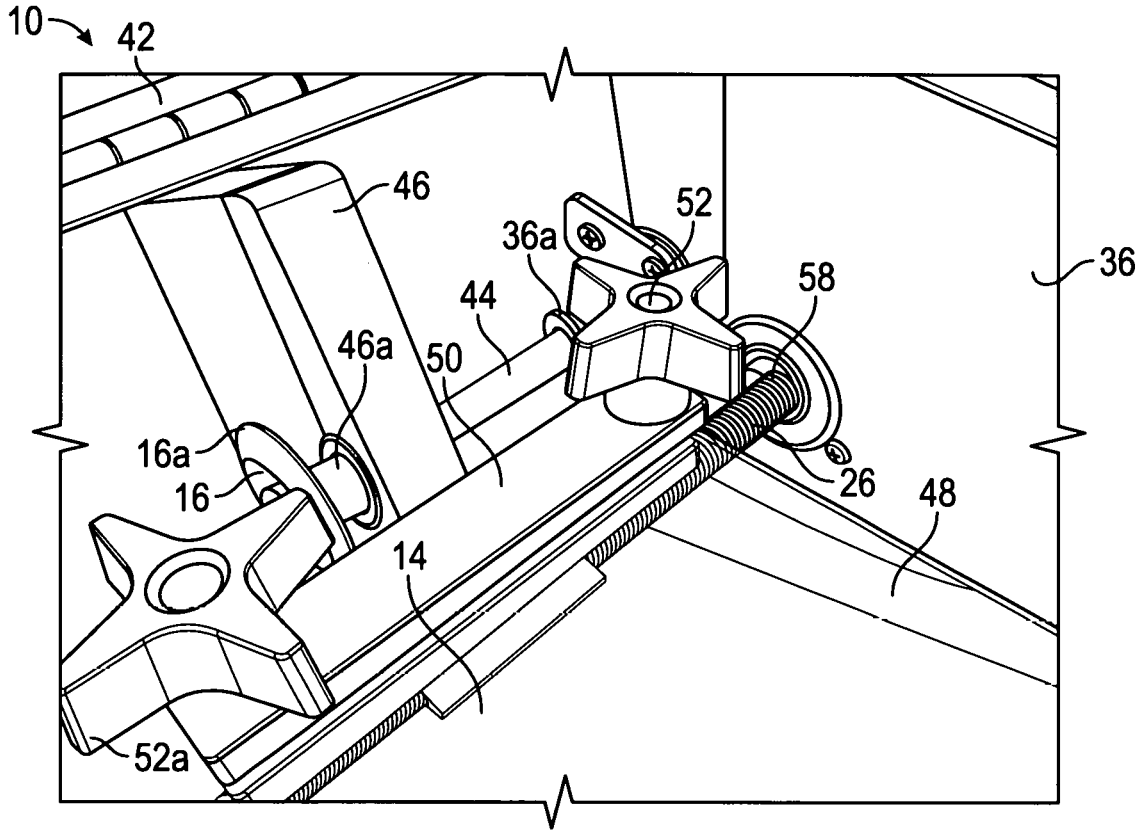
FIG. 2 is an enlarged upper perspective view of the blade sharpening apparatus, showing an interior of the housing from a different angle from that shown in FIG. 1.

The grinding wheel 16, as shown in FIG. 2, is attached at a shaft 44 that is rotatably coupled with the base structure 30. The shaft 44 extends through an internal support 46 near the grinding wheel 16 that supports and reduces moment forces on the shaft 44 from the blade 12 being urged against the grinding wheel 16. As illustrated in FIG. 2, the internal support 46 includes a bearing 46*a* to reduce friction from rotation of the shaft 44. The shaft 44 also extends through the interior wall 36 of the housing, which provides a bearing 36*a* for rotationally supporting the shaft 44. On the other side of the interior wall 36, in the electrical component area 40, the shaft 44 engages the electric motor 20 to rotate the shaft 44 and thereby also the grinding wheel 16. It will be appreciated that in additional embodiments, one or more of the bearings 36*a*, 46*a* may be replaced with bushings or like. The electric motor 20 may be configured to operate from one or more various voltages, such as a 120 VDC motor, and may also be electrically connected to and powered by a power supply 21, such as shown in FIGS. 1 and 2 disposed in the electrical component area 40. Optionally, the electric motor 20 may also or alternatively be operated by a battery, such as a battery stored in the housing. The shaft 44 extends linearly from the electric motor 20 to the grinding wheel 16 along the fixed rotational axis 18 of the grinding wheel 16. It is contemplated that the grinding wheel in additional embodiments may be directly or indirectly coupled with the electric motor or other rotational power source, such as via a set of gears or the like.

The grinding wheel 16 is located on or rotatably attached at the base structure 30 in a position for the edge 16*a* of the wheel 16 to engage the sharpened portion of the teeth spaced along the serrated edge 12*a* of the blade 12 held by the blade holder 14. The edge 16*a* of the grinding wheel 16 generally corresponds with the shape of the teeth on the serrated blade 12, such that the grinding wheel 16 may be replaced with a differently shaped grinding wheel to correspond with a differently selected blade that has differently shaped teeth along the serrated edge. Thus, the grinding wheel may have different sized and shaped edges and may also or alternatively be made to have different materials bonded to the periphery of the edge, such as industrial diamonds for diamond wheel and other materials or combinations thereof, such as zirconia, silicon carbide, ceramic, aluminum oxide, or other abrasive compounds.

Figure 4:
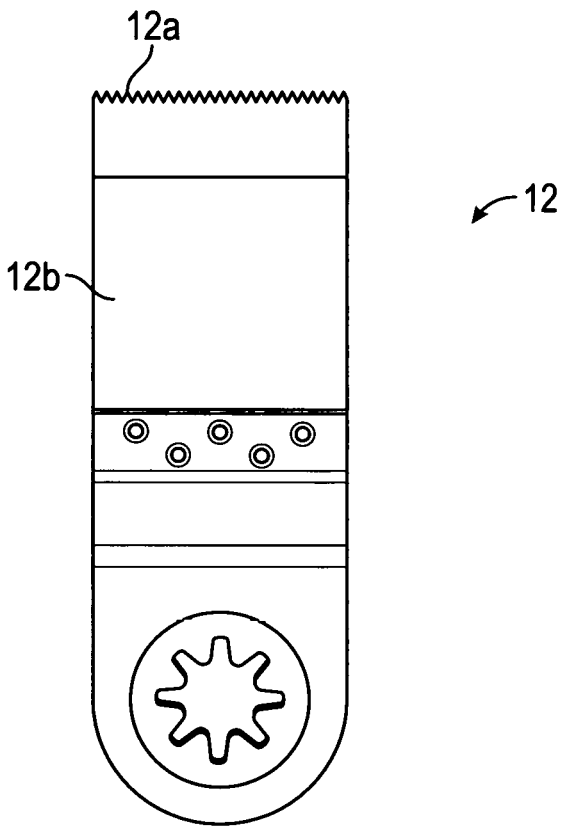
FIG. 4 is an elevational view of a serrated blade having a toothed or serrated edge configured to be sharpened by a blade sharpening apparatus in accordance with the present invention.
Figure 4A:
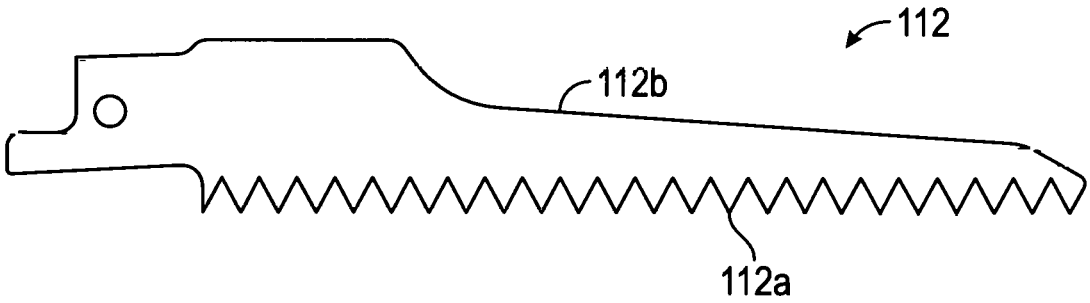
FIG. 4A is an elevational view of an additional embodiment of a serrated blade.

The blade holder 14 securely holds the serrated blade 12 to expose the serrated edge 12*a*, such as by clamping along a back portion 12*b* of the blade 12 (FIG. 4). Various types of blades may be held in the blade holder 14, such as, for example, the different blades 12 and 112 shown in FIGS. 4 and 4A, which each have a generally linear arrangement of teeth along the serrated edge 12*a*, 112*a* and a corresponding back portion 12*b*, 112*b* to be engaged by the blade holder 14. As shown in FIG. 3, the blade holder 14 includes a clamping device that has a base plate 48 and a movable part or jaw 50 that is configured to be drawn toward the base plate 48 via one or more threaded fasteners 52 for clamping the back portion 12*b* of the serrated blade 12 between the base plate 48 and the movable part 50 in a clamped position. The threaded fasteners 52 each have a handle portion 52*a* for manually rotating and tightening the blade into the clamped position. By clamping along the back portion 12*b* of the blade 12, the blade 12 is reinforced and firmly supported for sharpening each tooth or serration along the serrated edge 12*a*, so as to minimize loads on the blade 12 that could cause bending or distortion to the serrated edge 12*a*. The plate 48 may also comprise a transparent material, such as glass to polymer, to provide at least a portion of the plate 48 that is transparent for viewing the interaction between the blade 12 and the grinding wheel 16, while also deflecting sparks and/or debris from operation of the grinding wheel 16. It is also conceivable that in additional embodiments the blade holder may also or alternatively include biasing clamps or other alternative attachment devices for firmly securing the blade in place. Furthermore, it is conceivable that the blade holder may include a heat sink, such as at the base plate or movable part of the clamping device or other piece that may contact the blade, for drawing and expelling heat away from the blade during and after sharpening.

To move the blade 12 and grinding wheel 16 relative to each other to effectuate the grinding process of the serrated edge 12*a*, the oscillating mechanism 22 and linear actuator 24 are operated to coincide longitudinal and lateral movements to correspond to the shape of the serrated edge 12*a*, such as to sharpen along the general depth and spacing of the teeth or serrations. With respect to the oscillating mechanism 22, it may comprise a support member, such as the illustrated threaded rod 26, which is attached at a rotational coupling 28 to position the supported device, such as the blade holder or the grinding wheel, at an offset location from a central axis 28*a* of the rotational coupling 28 to provide the oscillation movement. As shown in FIGS. 1-3, the threaded rod 26 is attached at the offset location on the rotational coupling 28 and is engaged by a threaded support member 48*a*. The threaded support member 48*a* freely rotates on the threaded rod 26, such that only the offset rotation is imparted to the blade holder 14 about the central axis 28*a* in a manner that maintains the generally horizontal orientation of the blade 12 as it rotates the blade holder 14 about the central axis 28*a*.

To assist with maintaining the generally horizontal orientation of the blade 12 during the lateral oscillation, the blade holder 14 extends generally away from the grinding wheel 16 to engage a support rod 54. The support rod 54 is disposed in substantially parallel alignment with and at a spaced distance from the threaded rod 26. To engage the support rod 54, the blade holder 14 includes a pivot block 56 that is disposed at an opposing end of the base plate 48 from the movable part 50 of the clamping device, where the pivot block 56 includes an oval or stadium shaped aperture 56*a*. As shown in FIG. 1, the support rod 54 extends through the aperture 56*a* in the pivot block 56 so that the support rod 54 can acts as a pivot point for the base plate 48 of the blade holder 14, while also allowing movement of the support rod 54 within the long dimension of the oval shape of the aperture 56*a* to account for the lateral oscillation. As such, the blade holder 14 moves back and forth laterally relative to the generally fixed location of the grinding wheel 16. The illustrated blade sharpening apparatus 10 oscillates the blade in a consistent pattern that is configured to correspond to the depth of the teeth along the serrated edge 12*a* of the blade 12.

The linear actuator 24 comprises a threaded rod engaged by the supported device, such as the blade holder or the grinding wheel, whereby the longitudinal movement is induced or provided upon rotation of the threaded rod or by rotation of the support element engaging the threaded rod. As shown in FIGS. 1-3, the threaded rod 26 is attached at a rotational coupling 28, such that in response to rotation of the threaded rod 26, the blade holder 14 that is supported on and engaged with the threads of the threaded rod 26 is moved longitudinally along the axis of the threaded rod 26 to move the blade 12 along the grinding wheel 16. Specifically, the threaded support member 48*a* that is disposed at a bottom side of the base plate 48 on the blade holder 14 and is engaged with the threads of the threaded rod 26, so that the rotation of the threaded rod 26 imparts longitudinal movement of the blade holder 14 along the threaded rod 26, in substantially parallel alignment with the rotational axis of the grinding wheel 16. Accordingly, the threaded rod 26 has a thread pattern that is configured to longitudinally move the blade holder 14 a set distance per revolution of the threaded rod 26 that corresponds with a centered distance between teeth on the serrated edge 12*a* of the blade 12.

Each revolution of the threaded rod 26 correlates to lateral movement that corresponds to at least the depth of the teeth along the serrated edge 12*a* of the blade 12, as the threaded rod 26 is disposed at an offset distance away from the central axis 28*a* of the rotational coupling 28 that is at least half of the depth of the teeth. The illustrated threaded rod 26 is rotated via a hand crank that is attached at the rotational coupling 28 at an exterior portion of the housing 32, so as to allow the user to adjust the speed at which the threaded rod 26 rotations, and thus the speed at which the blade holder 14 moves laterally and longitudinally relative to the grinding wheel 16. It is also contemplated that the threaded rod 26 may be rotated at the rotational coupling 28 via an electric motor, such as the electric motor used for the grinding wheel that is geared to the desired rotational speed via a set of gears. It is also contemplated that the threaded rod may be replaceable with a different threaded rod have a different thread pattern, such as a different pitch or teeth per inch, which corresponds to how course or fine the teeth on the sharpened blade are cut.

In additional embodiments of the blade sharpening apparatus, it is contemplated that the clamping mechanism and the blade holder may be fixed to the base structure, such that the grinding wheel oscillates laterally and moves longitudinally along the fixed blade. Alternatively, the grinding wheel may configured to be oscillated, such as with an offset rotational axis or other oscillating mechanism, and thus the blade holder may simply be configured to hold the blade fixed or to move the blade only longitudinally along the oscillating grinding wheel. Likewise, it is contemplated that the blade holder may configured to be oscillated, such as with an offset rotational axis or other oscillating mechanism, and thus the grinding wheel may simply be configured to move longitudinally along the oscillating blade holder. Furthermore, it is conceivable that in additional embodiments, the mechanisms necessary to impart the longitudinal and lateral movement may also or alternatively include the use of hydraulic or pneumatic actuators, servo motors, cams, rack and pinion, and gears or the like.

Figure 5:
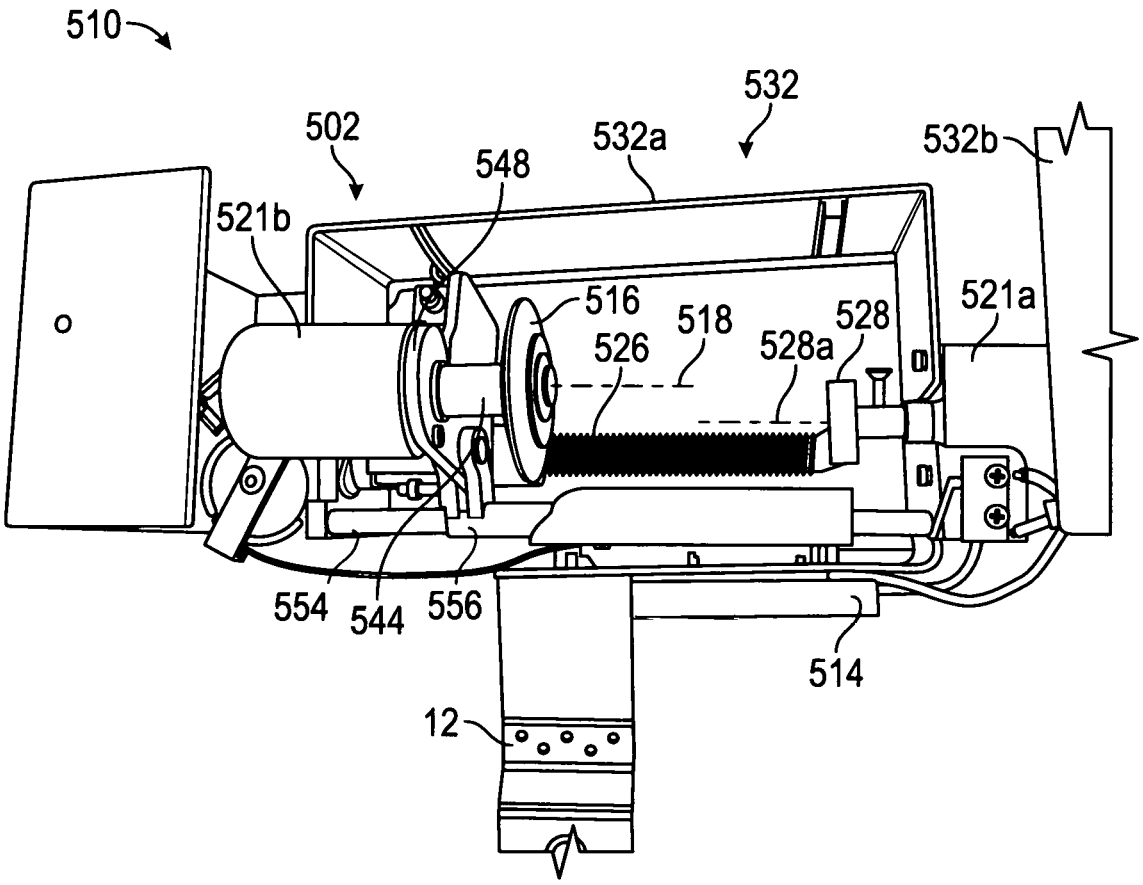
FIG. 5 is top-down perspective view of an additional embodiment of a blade sharpening apparatus, in accordance with the present invention.
Figure 6:
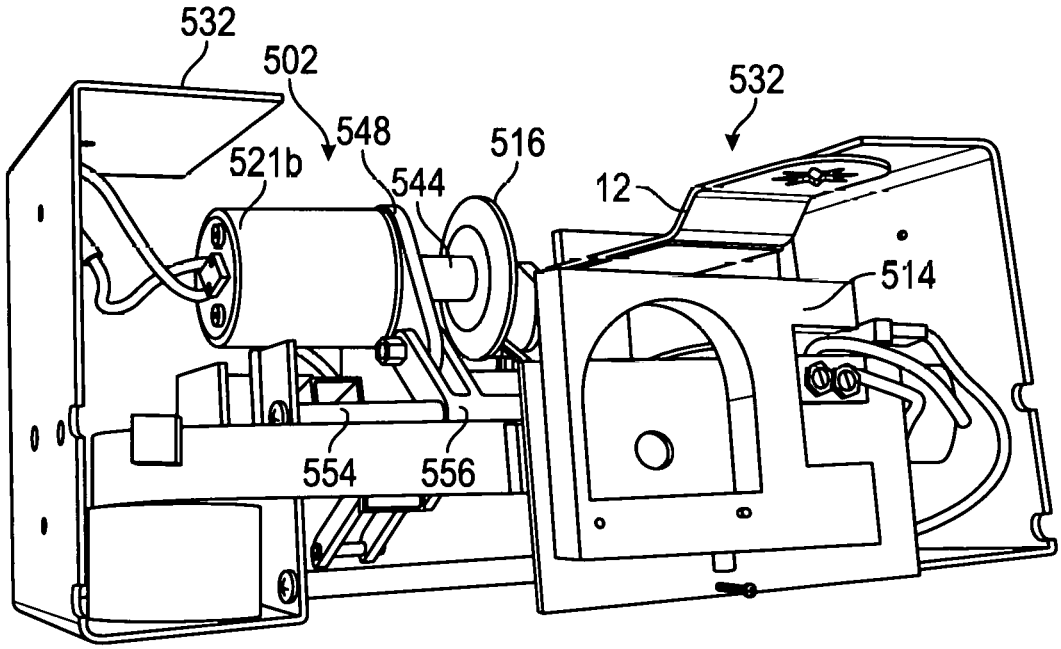
FIG. 6 is an upper perspective view of the blade sharpening apparatus of FIG. 5 with the blade sharpening apparatus turned on its side and viewed from an angle, in accordance with the present invention.
Figure 7:
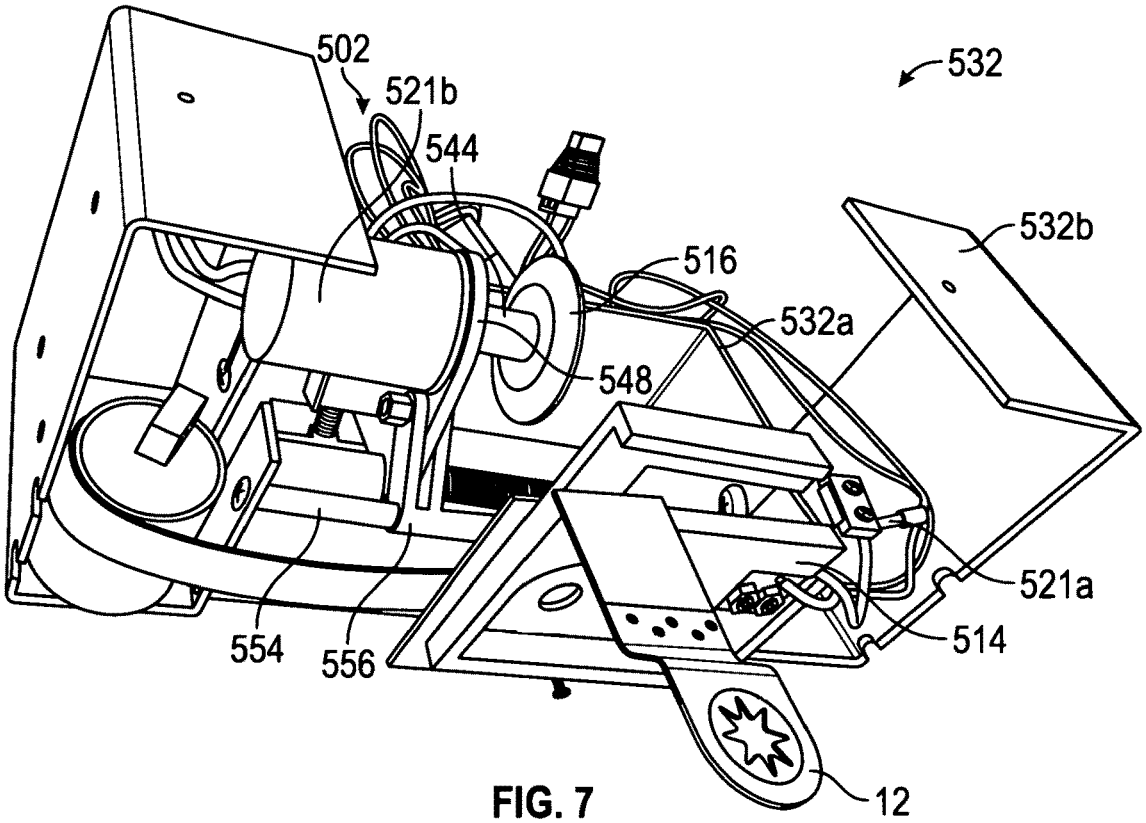
FIG. 7 is an upper perspective view of the blade sharpening apparatus of FIG. 5 with the blade sharpening apparatus rotated along its longitudinal axis, in accordance with the present invention.

In another exemplary embodiment, a blade sharpening apparatus 510 comprises a motorized grinding wheel assembly 502 and a blade holder 514, as shown in FIGS. 5-9. As discussed herein, an oscillating mechanism and a linear actuator are synchronized to provide a coordinated longitudinal and lateral movement of the motorized grinding wheel with respect to the blade holder 514. As also illustrated in FIGS. 5-9, the blade sharpening apparatus 510 includes a simple housing/framework 532 comprising an inner frame 532*a* and an outer frame 532*b*, in which the base structure, floor, exterior and interior walls, and a lid/cover of a housing (as illustrated in FIG. 1), have been removed to show internal structure. The motorized grinding wheel assembly 502 includes a grinding wheel 516, a shaft 544, a support member 548, and an electric grinder motor 521*b*. As illustrated in FIG. 5, the shaft 544 and grinding wheel 516 are configured to rotate around grinding wheel axis 518. As best illustrated in FIGS. 6 and 7, the blade holder 514 is affixed to the housing/framework 532. The blade holder 514 is configured to securely hold a serrated blade 12, such as with a clamping device, to expose a toothed or serrated edge 12*a* of the blade for sharpening (see FIG. 4).

Figure 8:
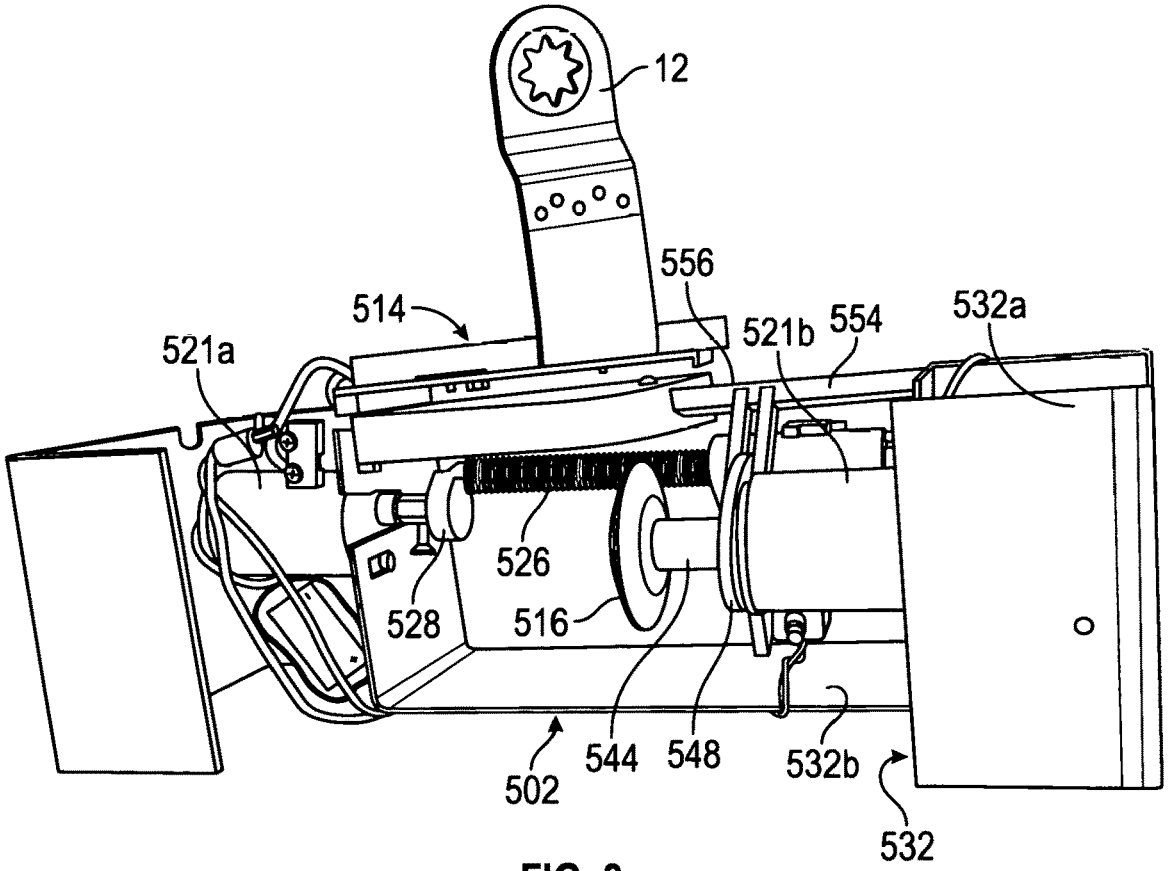
FIGS. 8 and 9 are upper perspective views of the blade sharpening apparatus of FIG. 5 with the blade sharpening apparatus rotated further along its longitudinal axis, in accordance with the present invention.
Figure 9:
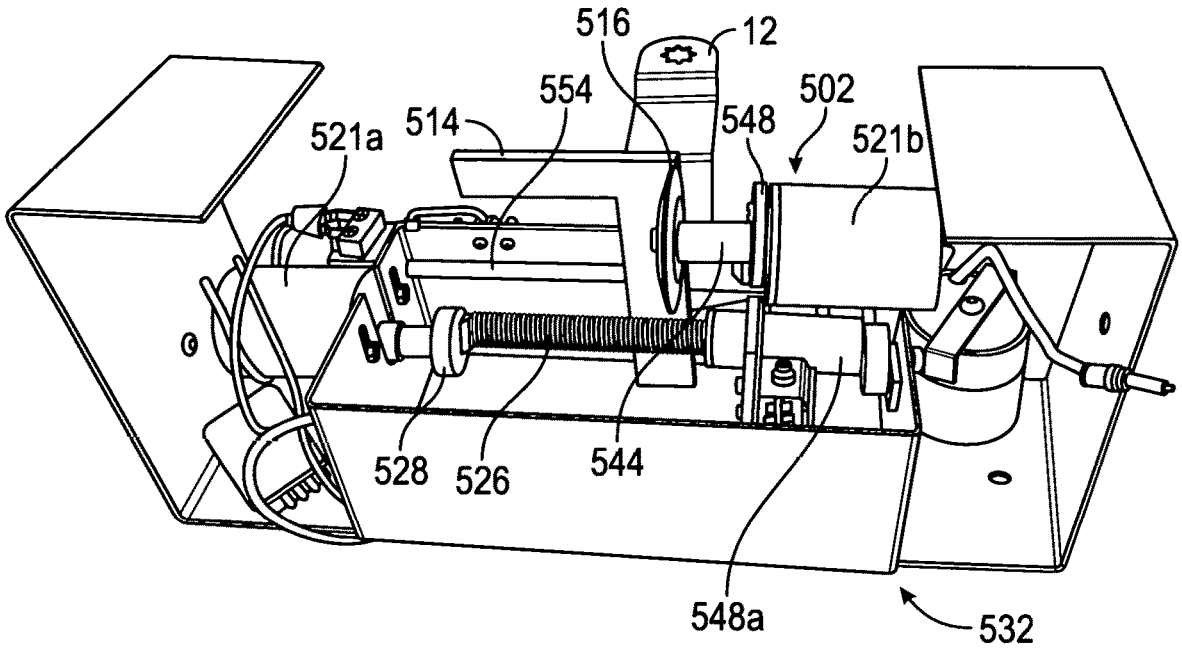

As illustrated in FIGS. 5, 8, and 9, the linear actuator (providing the longitudinal movement) comprises a threaded rod 526 and a threaded support member 548*a* threadedly coupled to the threaded rod 526. The threaded support member 548*a* is coupled to the support member 548, such as shown in FIG. 9. Rotation of the threaded rod 526 provides a linear, longitudinal movement of the motorized grinded wheel 516 along the grinding wheel axis 518, while the grinding wheel 516 traverses a generally sinusoidal and arcuate path about a grinding path axis 528*a* with respect to the fixed blade holder 514 when the threaded rod 526, via an offset rotational coupling 528, is rotated by an electric drive motor 521*a*. As illustrated in FIG. 5, the linear, longitudinal movement of the motorized grinding wheel assembly 502 is with respect to grinding wheel axis 518 and is at all times parallel to the threaded rod 526.

As also illustrated in FIGS. 5, 8, and 9, the oscillating mechanism comprises the threaded support member 548*a*, the support member 548, a pivot block 556, and the offset rotational coupling 528 via the threaded rod 526. As illustrated in FIG. 5, the threaded rod 526 is affixed to the rotational coupling 528, which provides an offset rotation about the grinding path axis 528*a* when the offset rotational coupling 528 is rotated by the electric drive motor 521*a*. As illustrated in FIGS. 5 and 9, the offset rotation of the threaded support member 548*a* provides an oscillating lateral movement to the motorized grinding wheel assembly 502, via the support member 548, such that the motorized grinding wheel assembly 502 laterally shifts in an oscillating fashion towards and away from contact with the serrated or toothed edge of the tool 12 that is mounted in the tool holder 514. As illustrated in FIG. 5, such lateral movement of the motorized grinding wheel assembly 502 is guided by the pivot block 556 as the pivot block 556 pivots about a support rod 554 in reaction to the oscillating lateral movement of the threaded support member 548*a*, as it rotates in an offset fashion about the grinding path axis 528*a*. The combination of linear movement and oscillating arcuate lateral movement creates a generally sinusoidal path of the grinding wheel 516 as it traverses along the blade to be sharpened.

It will be appreciated that during operation of blade sharpening apparatus 510, the grinding wheel axis 518 and threaded rod 526 each trace a respective oscillating arcuate path while remaining parallel to the grinding path axis 528*a*. The arc length or amplitude of the arcuate path traced by the grinding wheel axis 518 is determined by the offset distance between the longitudinal axis of the threaded rod 526 and the grinding path axis 528*a*, according to the offset rotational coupling 528. Thus, the arc length or amplitude of the oscillating arcuate path traced by the grinding wheel 516 can be set according to the choice of rotational coupling 528, and a plurality of different rotational couplings 528 may be provided so that a user may select the appropriate arc length or amplitude of oscillating arcuate path that will be traced by the grinding wheel 516 during operation of the drive motor 521*a*. Similarly, the pitch of the sinusoidal path can be set according to the pitch of the threads along the threaded rod 526, which may also necessitate a corresponding change of the threaded support member 548*a*.

Therefore, as illustrated in FIGS. 5-9, the coordinated motions of the threaded rod 526, that is coupled to the offset rotational coupling 528 and threadedly coupled to the threaded support member 548*a*, that is coupled to the support member 548, as well as the pivot block 556, that is also coupled to the support member 548, and arcuately pivots about the pivot shaft 554, are configured to provide the coordinated lateral and longitudinal movements between the motorized grinding wheel assembly 502 and the fixed blade holder 514. As also described hereinabove, each revolution of the threaded rod 526 also correlates to lateral movement or amplitude that corresponds to at least the depth of the teeth along the serrated edge 12*a* of the blade 12, as the threaded rod 526 is disposed at an offset distance away from the grinding path axis 528*a* of the offset rotational coupling 528 that is typically about half of the depth of the teeth.

The threads of the threaded rod 526 and receiving grooves of the threaded support member 548*a* are sized with respect to the size of the teeth 12*a*, 112*a* of the serrated edge of the tool 12, 112, such that the longitudinal and lateral movements of the motorized grinding wheel assembly 502 are dimensioned according to the size of the teeth 12*a*, 112 of the serrated edge of the tool 12, 112, respectively. It is also contemplated that the threaded rod may be replaceable with a different threaded rod have a different thread pattern, such as a different pitch or teeth per inch, which corresponds to how course or find the teeth on the sharpened blade are cut.

In operation, the blade sharpening apparatus is prepared for grinding by securing a blade at the blade holder to expose the serrated edge of the blade. The tooth or serration shape of the blade can be examined to determine the appropriate grinding wheel and corresponding lateral and longitudinal movements to follow and sharpen the serrated edge. When the blade sharpening apparatus has been configured for the selected blade, the grinding wheel is rotated about its rotational grinding wheel axis, such as via the electric grinding motor. The blade holder and/or the grinding wheel is then oscillated relative to the other at an oscillating arc length that is configured to sharpen the blade along the depth between teeth spaced along the serrated edge of the selected blade. Also, the blade holder and the grinding wheel are moved longitudinally relative to each other in substantially parallel alignment with the rotational grinding wheel axis. The longitudinal and lateral movements are configured to coincide in a manner that corresponds to the depth and spacing of the teeth along the serrated edge of the blade. When the blade sharpening has been completed, the grinding wheel may stop and the associated housing may be opened, such as via a cover, to remove the blade from the blade holder. Optionally, the housing may include a slide out tray in the sharpening area for collecting debris from sharpening, so as to easily be removed and emptied for cleaning the accumulated debris.

Therefore, exemplary embodiments of the present invention provide for a coordinated longitudinal and lateral movement between a grinding wheel and a serrated blade such that those longitudinal and lateral movements are configured to coincide in a manner that corresponds to the depth (amplitude) and spacing (pitch) of the teeth along the serrated edge of the blade.

Changes and modifications in the specifically-described embodiments may be carried out without departing from the principles of the present invention, which is intended to be limited only by the scope of the appended claims as interpreted according to the principles of patent law including the doctrine of equivalents.

The invention claimed is:

1. A blade sharpening apparatus for sharpening a serrated blade, said blade sharpening apparatus comprising:

a blade holder configured to securely hold a serrated blade in a position that exposes a toothed edge of the serrated blade;

a grinding wheel configured to rotate about a rotational axis and engage teeth spaced along the toothed edge of the serrated blade;

an oscillating mechanism configured to laterally oscillate one of the blade holder and the grinding wheel relative to the other at an oscillating amplitude that corresponds to a depth between the teeth on the serrated blade;

a linear actuator coupled with one of the blade holder and the grinding wheel and configured to longitudinally move substantially parallel with the rotational axis of the grinding wheel, wherein the linear actuator is operable with the oscillating mechanism to coincide the longitudinal and lateral movement to correspond to the depth and spacing of the teeth disposed along the serrated blade, and wherein the linear actuator comprises a threaded rod attached at a rotational coupling at an offset location from a central axis of the rotational coupling to provide the lateral oscillation; and a base structure stationary relative to the coinciding longitudinal and lateral movement provided by the respective linear actuator and oscillating mechanism, wherein the rotational coupling is rotatably coupled with an electric motor that is supported at the base structure.

2. The blade sharpening apparatus of claim 1, wherein the oscillating mechanism comprises a support member attached at a rotational coupling that positions the blade holder or the grinding wheel at an offset location from a central axis of the rotational coupling to provide the lateral oscillation.

3. The blade sharpening apparatus of claim 1, wherein the threaded rod is engaged by the blade holder or the grinding wheel and configured, upon rotation of the threaded rod, to provide the longitudinal movement of the linear actuator.

4. The blade sharpening apparatus of claim 3, wherein the oscillating mechanism comprises a support rod disposed in substantially parallel alignment with the threaded rod and at a spaced distance from the threaded rod to support the blade holder or the grinding wheel that is laterally oscillated.

5. The blade sharpening apparatus of claim 1, wherein the grinding wheel is rotatably coupled with the electric motor that is supported at the base structure.

6. A blade sharpening apparatus for sharpening a serrated blade, said blade sharpening apparatus comprising:

a base structure configured to rest on a support surface;

a blade holder coupled with the base structure and configured to securely hold a serrated blade in a position that exposes a toothed edge of the serrated blade;

a threaded rod rotatably coupled with the base structure and rotatable about a rotational axis that is offset a fixed offset distance from a center axis of the threaded rod;

a support rod coupled with the base structure in substantially parallel spaced alignment with the rotational axis of the threaded rod; and a grinding wheel rotationally attached to a shaft and configured to engage teeth spaced along the toothed edge of the serrated blade that is secured in the blade holder, wherein the grinding wheel is engaged with the threaded rod and the support rod;

wherein, responsive to rotation of the threaded rod about the rotation axis, the grinding wheel is movable in coinciding oscillating lateral movement and linear longitudinal movement against the serrated blade to sharpen the toothed edge of the serrated blade.

7. The blade sharpening apparatus of claim 6, wherein the blade holder comprises a clamping device that is configured to securely hold the serrated blade.

8. The blade sharpening apparatus of claim 7, wherein the clamping device of the blade holder comprises a base plate and a movable part that is configured to be drawn toward the base plate via a threaded fastener for clamping the serrated blade between the base plate and the movable part.

9. The blade sharpening apparatus of claim 6, wherein the blade holder comprises a plate extending between the threaded rod and the support rod, and wherein the plate is configured to deflect sparks and/or debris from operation of the grinding wheel.

10. The blade sharpening apparatus of claim 9, wherein the plate comprises a transparent polymer.

11. The blade sharpening apparatus of claim 6, wherein the shaft that is attached to the grinding wheel is coupled with an electric motor.

12. The blade sharpening apparatus of claim 6, wherein the threaded rod comprises a thread pattern that is configured to longitudinally move the grinding wheel a set distance per revolution of the threaded rod that corresponds with a centered distance between teeth of the serrated blade.

13. The blade sharpening apparatus of claim 6, wherein the fixed offset distance is selected such that an oscillating amplitude of the grinding wheel corresponds to a depth of teeth of the serrated blade.

14. The blade sharpening apparatus of claim 6 further comprising an electric motor configured to rotate the threaded rod.

15. A method of sharpening a serrated blade, said method comprising:

securing a blade at a blade holder to expose a serrated edge of the blade;

rotating a grinding wheel about a rotational axis;

laterally oscillating one of the blade holder and the grinding wheel relative to the other at an oscillating amplitude corresponding to a depth between teeth spaced along the serrated edge of the blade;

rotating a threaded rod that is engaged by the blade holder or the grinding wheel to longitudinally move the engaged blade holder or the grinding wheel in substantially parallel alignment with the rotational axis of the grinding wheel;

wherein the longitudinal and lateral movement coincide to correspond to the depth and spacing of the teeth along the serrated edge of the blade; and wherein the grinding wheel and the threaded rod are each rotated by a respective electric motor.

16. The method of claim 15, wherein the threaded rod is configured, upon rotation, to provide the longitudinal movement.

17. The method of claim 16, wherein laterally oscillating one of the blade holder and the grinding wheel relative to the other at an oscillating amplitude comprises attaching the threaded rod to a rotational coupling at an offset location from a central axis of the rotational coupling to provide the lateral oscillation.

* * * * *